US006776679B1

(12) United States Patent
Menow

(10) Patent No.: US 6,776,679 B1
(45) Date of Patent: Aug. 17, 2004

(54) SKIPPING TOY WITH DISCO BALL

(75) Inventor: Steven M. Menow, Yardley, PA (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 10/426,954

(22) Filed: May 1, 2003

(51) Int. Cl.[7] ..... A63H 1/00
(52) U.S. Cl. ..... 446/236; 446/26; 446/247
(58) Field of Search ..... 446/236, 26, 247, 446/219, 256, 257, 258, 259, 260, 261, 262, 263, 264

(56) References Cited

U.S. PATENT DOCUMENTS

| | | | | | |
|---|---|---|---|---|---|
| 446,535 | A | | 2/1891 | Outerbridge | |
| 1,214,863 | A | | 2/1917 | Woeste | |
| 3,140,871 | A | * | 7/1964 | Liquori | 482/81 |
| 3,165,315 | A | * | 1/1965 | Petrusek | 482/81 |
| 3,528,654 | A | * | 9/1970 | Larson et al. | 482/81 |
| 4,042,241 | A | | 8/1977 | Collins | |
| D281,889 | S | | 12/1985 | Bate et al. | |
| 4,601,474 | A | | 7/1986 | Lew et al. | |
| 4,645,471 | A | * | 2/1987 | Herring et al. | 446/258 |
| 4,875,675 | A | * | 10/1989 | Arad et al. | 482/81 |
| D309,484 | S | * | 7/1990 | Arad et al. | D21/672 |
| 5,603,651 | A | * | 2/1997 | Shure et al. | 446/16 |
| 6,113,452 | A | * | 9/2000 | McGowan et al. | 446/26 |
| 6,171,200 | B1 | | 1/2001 | Camp | |
| 6,595,827 | B2 | * | 7/2003 | Kirley | 446/219 |
| D478,136 | S | * | 8/2003 | Chang | D21/672 |
| 2003/0027484 | A1 | * | 2/2003 | Kessler | 446/247 |

FOREIGN PATENT DOCUMENTS

| | | |
|---|---|---|
| EP | 0 384 953 | 9/1990 |

* cited by examiner

*Primary Examiner*—Derris H. Banks
*Assistant Examiner*—Ali Abdelwahed
(74) *Attorney, Agent, or Firm*—Fish & Richardson P.C.

(57) ABSTRACT

A toy is described that, during play, is rotated in a horizontal circular path about a player's ankle and simultaneously provides illuminating and eye-catching reflections of ambient light. The toy includes a collar and a transparent housing connected to the collar by a tether. During play, the transparent housing rotates about the player's ankle, while the player simultaneously hops or skips the tether. The transparent housing contains a multi-faceted, reflective sphere. This multi-faceted, reflective sphere rotates or otherwise moves within the transparent housing so as to reflect ambient light in a sparkling manner.

20 Claims, 7 Drawing Sheets

SKIPPING TOY WITH DISCO BALL

TECHNICAL FIELD

This description relates to toys, and more particularly to skipping toys.

BACKGROUND

Conventional toys exist that include an element attached to a loop by a tether. A person plays with such a toy by, for example, loosely placing the loop around the ankle region of one of his or her legs, and then continuously moving the looped ankle in a small circular motion. In this way, the element horizontally revolves around the person's looped ankle, as long as the person raises the of his or her non-looped leg in a skipping or hopping motion during each revolution of the element, so as to avoid the tether as it moves with the element.

A person's ability to continuously twirl the element with one leg, while periodically raising the other leg so as not to impede the twirling of the element, provides an interesting game of physical dexterity and coordination.

SUMMARY

According to one general aspect, a toy includes a collar adapted to fit around an ankle region of a person, a tether having a first end attached to the collar, a housing attached to a second end of the tether, and a multi-faceted, reflective object mounted within the housing.

Implementations may include one or more of the following features. For example, the housing may be partially-transparent. The object may be substantially spherical in shape, and may be mounted within the housing so as to move independently of the housing. The object may be mounted within the housing so as to rotate about an axis that generally corresponds to an axis defined by an attachment shaft connecting the tether to the housing.

The object may be mounted within the housing by a pair of diametrically-opposed shaft elements extended from the object, where the shaft elements are substantially aligned with an attachment shaft connecting the tether to the housing. In this case, the shaft elements may be received within a pair of cup-shaped elements inside the housing.

The housing may be weighted so as to rotatably engage a ground surface along a circumference of the housing during a rotation of the object around the ankle region, where the circumference is defined at an outermost diameter of the housing. In this case, the object may be mounted within the housing such that an equator of the object is substantially aligned with the circumference of the housing. Also, a counter may be contained within the housing and may be operable to produce and visually display a count corresponding to a number of successive rotations of the housing around the ankle region.

According to another general aspect, a toy includes a loop adapted to encircle an ankle region of a user, a semi-transparent housing containing a reflective polyhedron, where the polyhedron is movably mounted with respect to the housing, and a cord connecting the loop to the housing.

Implementations may include one or more of the following features. For example, the polyhedron may be substantially spherical in outline. Opposing ends of the polyhedron may be respectively mounted within a pair of concave elements.

A central axis of the polyhedron may be substantially aligned with the cord during a rotation of the housing around the ankle region. In this case, the polyhedron may be rotatable about the central axis.

A central cross-section of the polyhedron may be aligned with an outer circumference of the housing. Also, a counter may be included with the toy that is operable to produce and display an indication corresponding to a number of successive rotations of the housing around the ankle region.

According to another general aspect, a toy may be operated. In so doing, a loop is around an ankle region of a first leg of a user, and the first leg is moved so as to swing a housing attached to the loop by a tether around the ankle region. A second leg of the user is moved so as to avoid impeding the housing as it swings around the ankle region, and ambient light that passes through the housing is reflected off of a multi-sided element contained within the housing.

Implementations may include one or more of the following features. For example, in reflecting ambient light through the housing, the element may be moved independently of the housing during the moving the first leg. Also, a counter may be implemented to count successive rotations of the housing around the ankle region as a function of a number of revolutions of the housing around an axis defined by the tether during the movement of the first leg.

The details of one or more implementations are set forth in the accompanying drawings and the description below. Other features will be apparent from the description and drawings, and from the claims.

DETAILED DESCRIPTION

Figure 1:
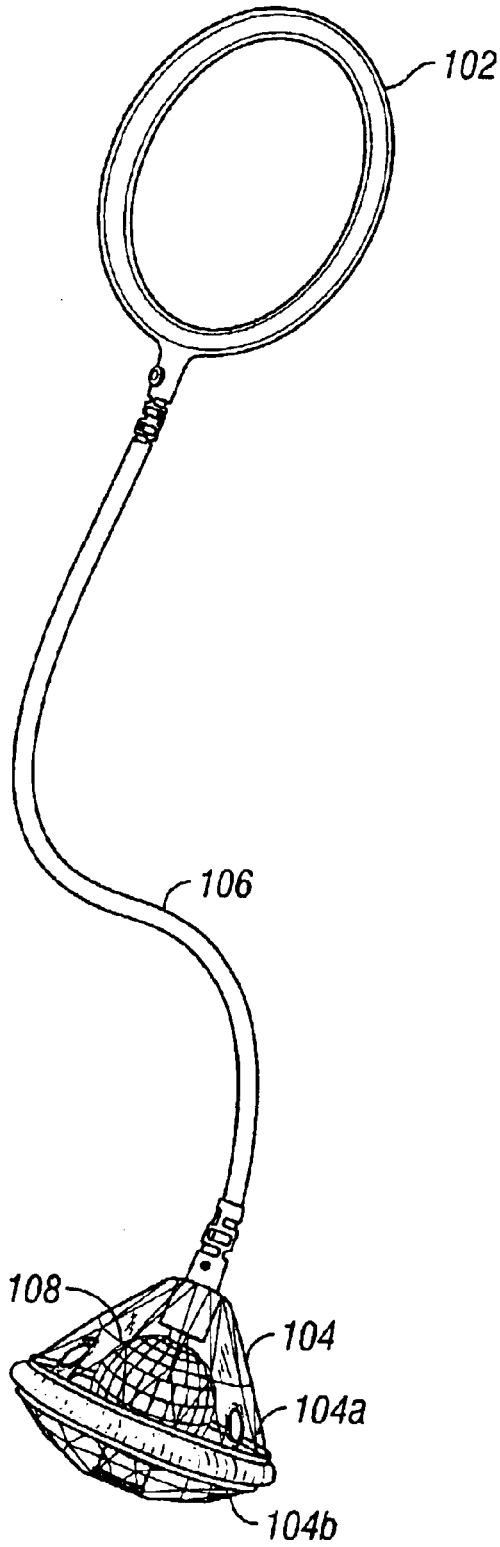
FIG. 1 is a perspective view of a skipping toy with a disco ball.

FIG. 1 is a perspective view of a skipping toy 100. In FIG. 1, the skipping toy 100 is illustrated as including a collar 102 connected to a housing 104. The collar 102 is suitably sized to allow a player to insert a foot therethrough, while allowing sufficient clearance about the ankle region of the player to avoid discomfort during play. The collar 102 may be made of, for example, any type of material that may be formed into a loop or circular shape for loose placement around an ankle region of a first leg of a player, as illustrated in FIG. 1. For example, the collar 102 may be formed of a plastic or rubber material. The collar 102 also may be referred to as a loop, ring, or other similar name.

The housing 104 is made of a transparent, semi-transparent, or translucent material. For example, the housing 104 may be formed of various types of plastic, may be completely transparent or translucent, and may be clear or colored (e.g., pink, blue, or green). The housing 104 also may contain openings that reveal an interior of the housing 104. The housing 104 also may be referred to as, for example, a drum or a container.

The housing may be integrally formed. In the implementation of FIG. 1, however, the housing 104 is formed of a first portion 104*a* and a second portion 104*b* that are snapped and screwed together. The housing portions also could be connected in other ways, such as through use of glue. In FIG. 1, the portions 104*a* and 104*b* are substantially cone-shaped in outline, but the portion 104*a* is deeper than the portion 104*b*. Both of the portions 104*a* and 104*b* include outer surfaces having multi-faceted arrangements that impart a jeweled appearance to the housing 104.

A flexible, elongated tether 106 of a predetermined length interconnects the collar 102 with the housing 104. Other mechanisms for interconnecting the collar 102 and the housing 104 also may be used as the tether 106. For example, the tether 106 may represent a rope, cord, or any other material that permits the housing 104 to rotate around the first leg of the player, while simultaneously revolving around an axis defined by the tether 106 during its rotation around the first leg of the player. Also, as with the collar 102 and the housing 104, the tether 106 may be referred to by other names, such as, for example, a shaft or cord.

As referred to above, a player may operate the skipping toy 100 of FIG. 1 by placing the collar 102 around an ankle region of a first leg of the player, and then moving the first leg so as to induce a circular, rotating motion of the housing 104 around the ankle region. The player may maintain this circular motion indefinitely by periodically raising, skipping, hopping or otherwise moving the player's other leg out of the way of the tether 106 as the tether 106 and the housing 104 rotate.

The skipping toy 100 further includes a disco ball 108 within the housing 104. The disco ball 108 is a multi-faceted, reflective object that, in the implementation of FIGS. 1–5, is substantially spherical in shape. More specifically, the disco ball 108 is a polyhedron defined by surfaces at angles to one another, and is substantially spherical in outline. Of course, the disco ball 108 could take a number of other shapes or forms, and could be, for example, substantially elliptical in outline.

The disco ball 108 is loosely mounted within the housing 104, and is movable within the housing 104. For example, the disco ball 108 may rotate within (and independently of) the housing 104, and/or may rock back and forth (appearing to float) within the housing 104. Due to the movement of the housing, the movement of the disco ball 108 within the housing 104, and the reflective nature of the surface(s) of the disco ball 108, ambient light in an area of use of the skipping toy 100, such as sunlight, is reflected in a dazzling, sparkling, or otherwise eye-catching manner.

Figure 2:
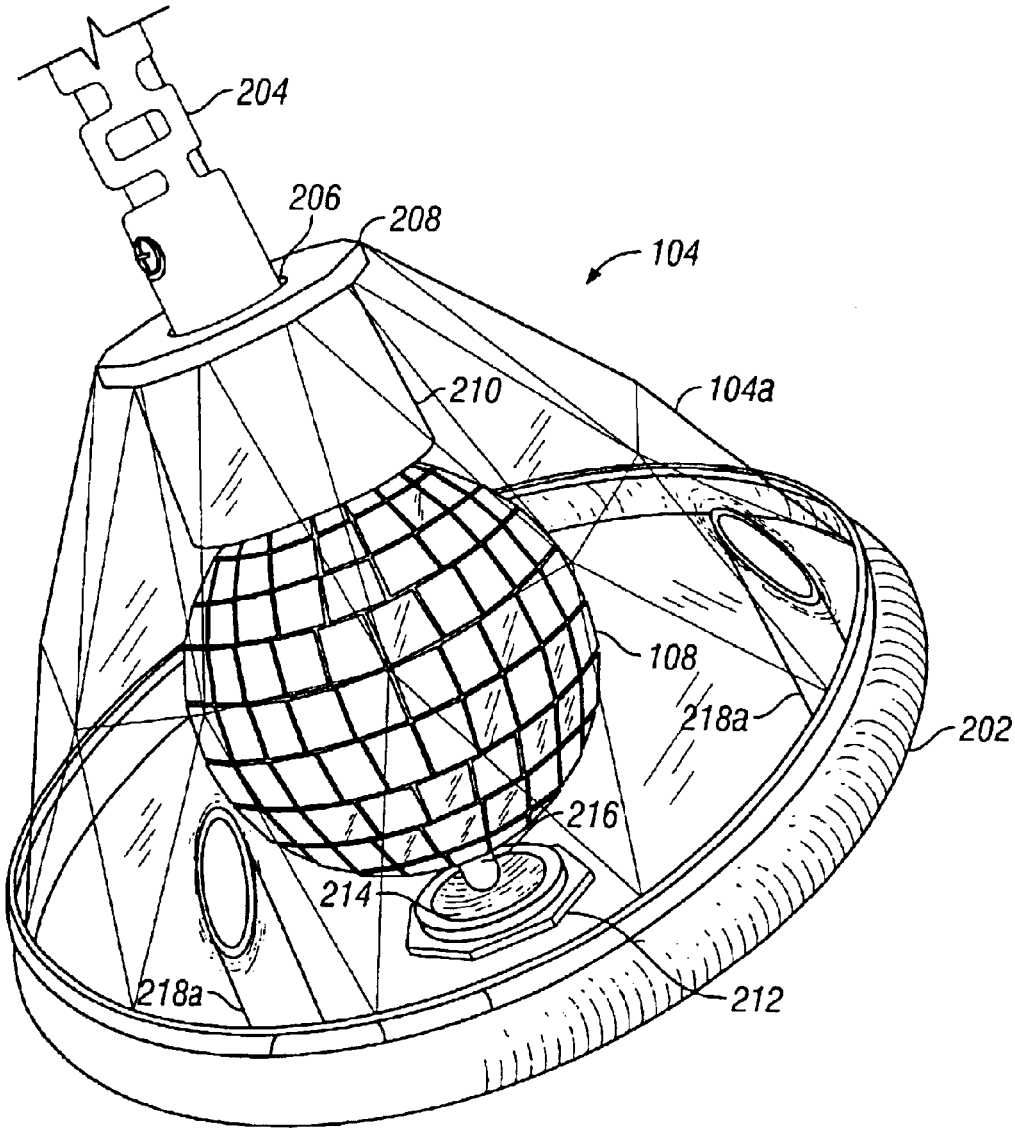
FIG. 2 is a magnified elevational view of a transparent housing and disco ball of the skipping toy of FIG. 1.

FIG. 2 is a magnified elevational view of the transparent housing 104 and the disco ball 108 of the skipping toy of FIG. 1. In FIG. 2, a protective ring 202 is more clearly shown as being fixed about a periphery of the housing 104. Ring 202 may be formed from, for example, a resilient elastomeric material that provides a skid-resistant contact surface about the periphery of housing 104. More specifically, as also can be seen in FIG. 1, the ring 202 may be formed about a perimeter of the housing 104 having the longest circumference of any perimeter of the housing 104, so as to ensure that the ring 202 remains in contact with the ground during play. To further ensure contact between the ring 202 and the ground, the housing 104 may be additionally weighted.

A shaft connector 204 connected to the tether 106 (not shown in FIG. 2) extends through an opening 206 in a housing base 208. In order to allow the rotation of the housing 104 along the ring 202 during play, as just described, it should be understood that the housing 104 is free to rotate about the shaft connector 204. Also, the shaft connector extends from the housing 104 along an axis that is generally perpendicular to the ring 202.

The shaft connector 204 extends through the opening 206 to connect with a first sphere receptacle 210. The first sphere receptacle 210 is substantially similar in form and function to a second sphere receptacle 212, which can be seen in greater detail in FIG. 2.

Specifically, the second sphere receptacle 212 can be seen to include a cup-shaped or concave portion 214 that is adapted to receive a shaft element 216 that is attached to the disco ball 108 along an axis defined by the tether during operation of the skipping toy 100. In this way, the disco ball 108 is free to spin about this axis essentially independently of a motion of the housing 104.

In other implementations, the disco ball 108 may be attached to the receptacles 210 and/or 212 in alternative fashions. For example, the receptacles 210 and 212 may be fashioned so that the disco ball 108 simply sits within the receptacles 210 and 212, without benefit of the shaft 216. In this way, the disco ball may be less likely to rotate, but may be more likely to rock back and forth or otherwise move within the housing 104.

As also shown in FIG. 2, evenly-spaced standards 218*a* serve to attach the first portion 104*a* of the housing 104 to the second portion 104*b* (not shown in FIG. 2) of the housing 104, and/or to generally provide support to elements of the housing 104. More specifically, as will be seen, corresponding standards 218*b* are included within the second portion 104*b* of the housing 104, which respectively snap or otherwise attach to the standards 218*a*.

Figure 3:
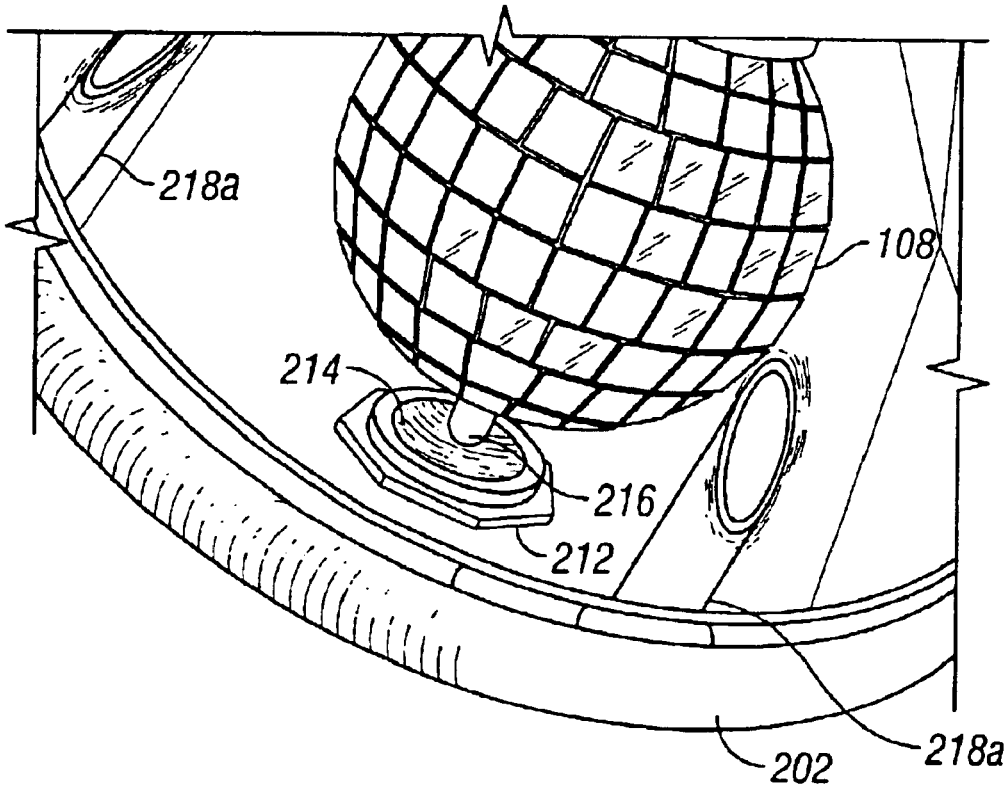
FIG. 3 is a further magnified elevational view of a transparent housing of the skipping toy of FIG. 1 showing an attachment of the disco ball to the housing in greater detail.

FIG. 3 is a further magnified elevational view of a transparent housing of the skipping toy of FIG. 1 showing an attachment of the disco ball to the housing in greater detail. In FIG. 3, the shaft 216 can be clearly seen to sit within the concave portion 214 of the second sphere receptacle.

Figure 4:
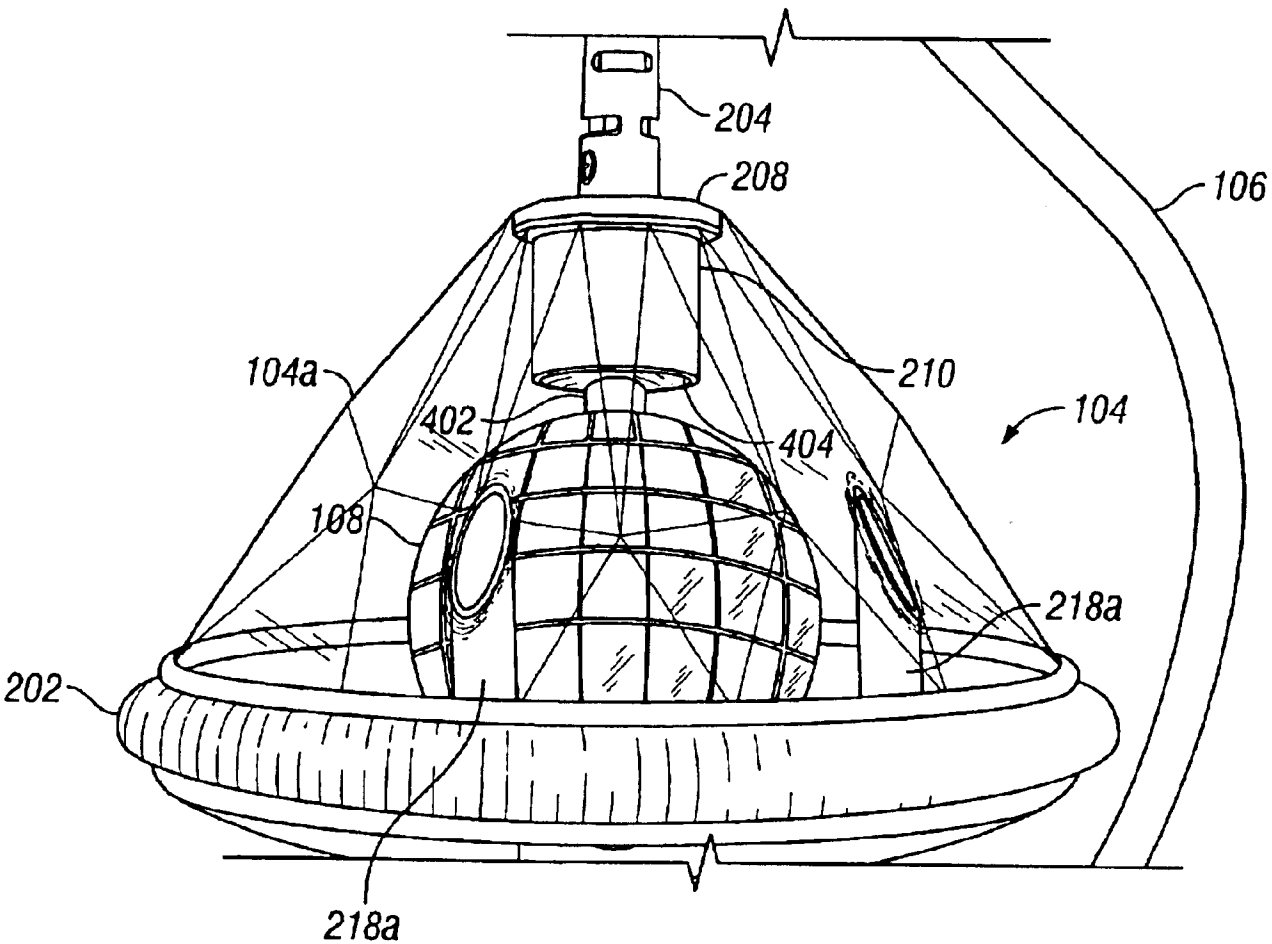
FIG. 4 is a side elevational view of the transparent housing and disco ball of FIG. 1.

FIG. 4 is a side elevational view of the transparent housing 104 and the disco ball 108. In FIG. 4, an interior portion of the first sphere receptacle 210 can be seen to receive a shaft 402 of the disco ball 108, within a cup-shaped or concave portion 404. Shaft 402 and portion 404 within the first sphere receptacle 210 correspond to the shaft 216 and cup-shaped portion 214 of the second sphere receptacle 212. In this way, as also explained above, the disco ball 108 is able to rotate within the housing 104.

Figure 5:
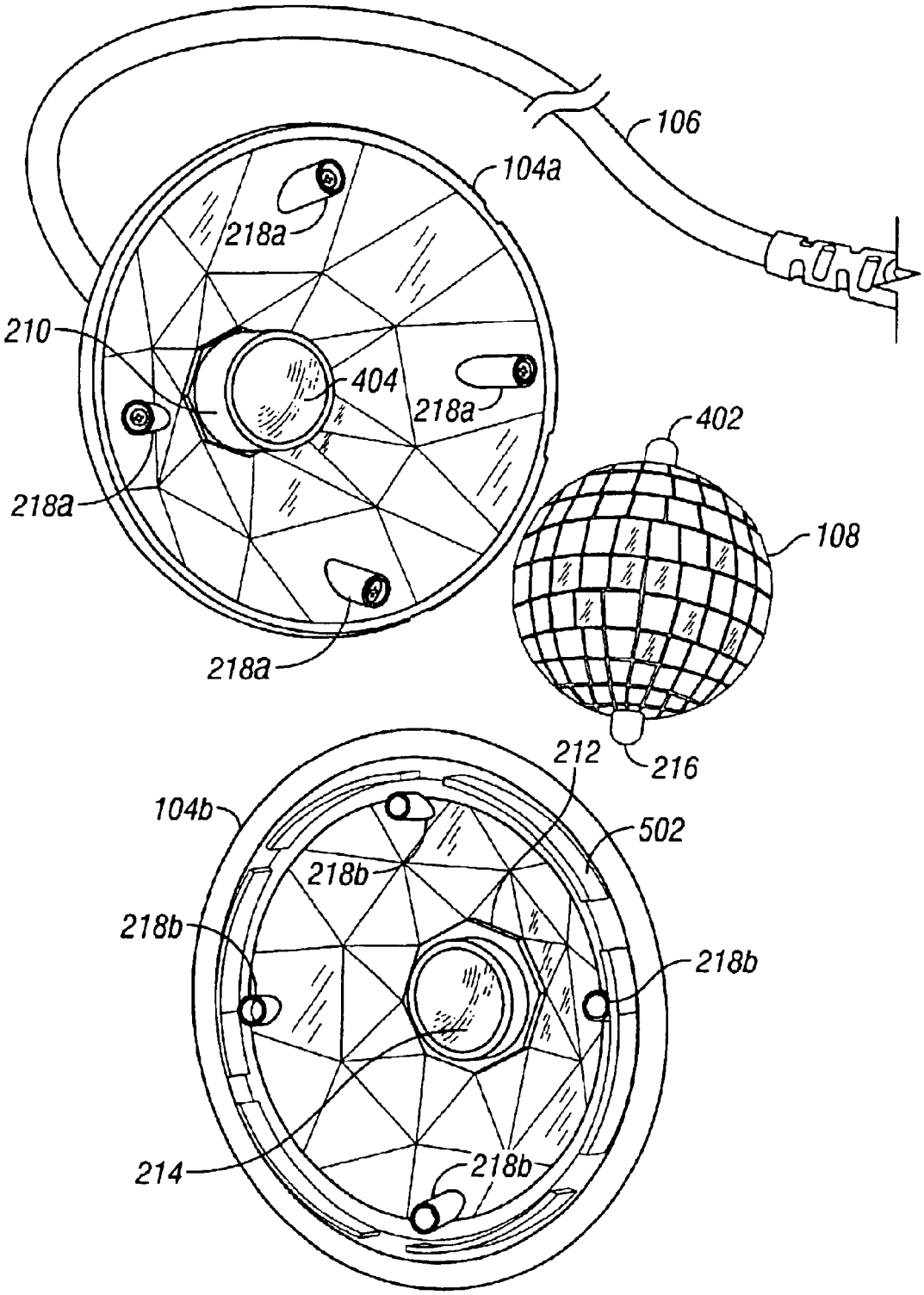
FIG. 5 is an exploded perspective view of the skipping toy of FIG. 1.

FIG. 5 is an exploded perspective view of the skipping toy of FIG. 1. FIG. 5 illustrates essentially all interior portions of the skipping toy 100, including additional is elements 502 within the second housing portion 104*b* that snap into the first housing portion 104*a*. The elements 502 help to more securely attach the housing portions 104*a* and 104*b*, and provide space in which the ring 202 may be attached.

Figure 6:
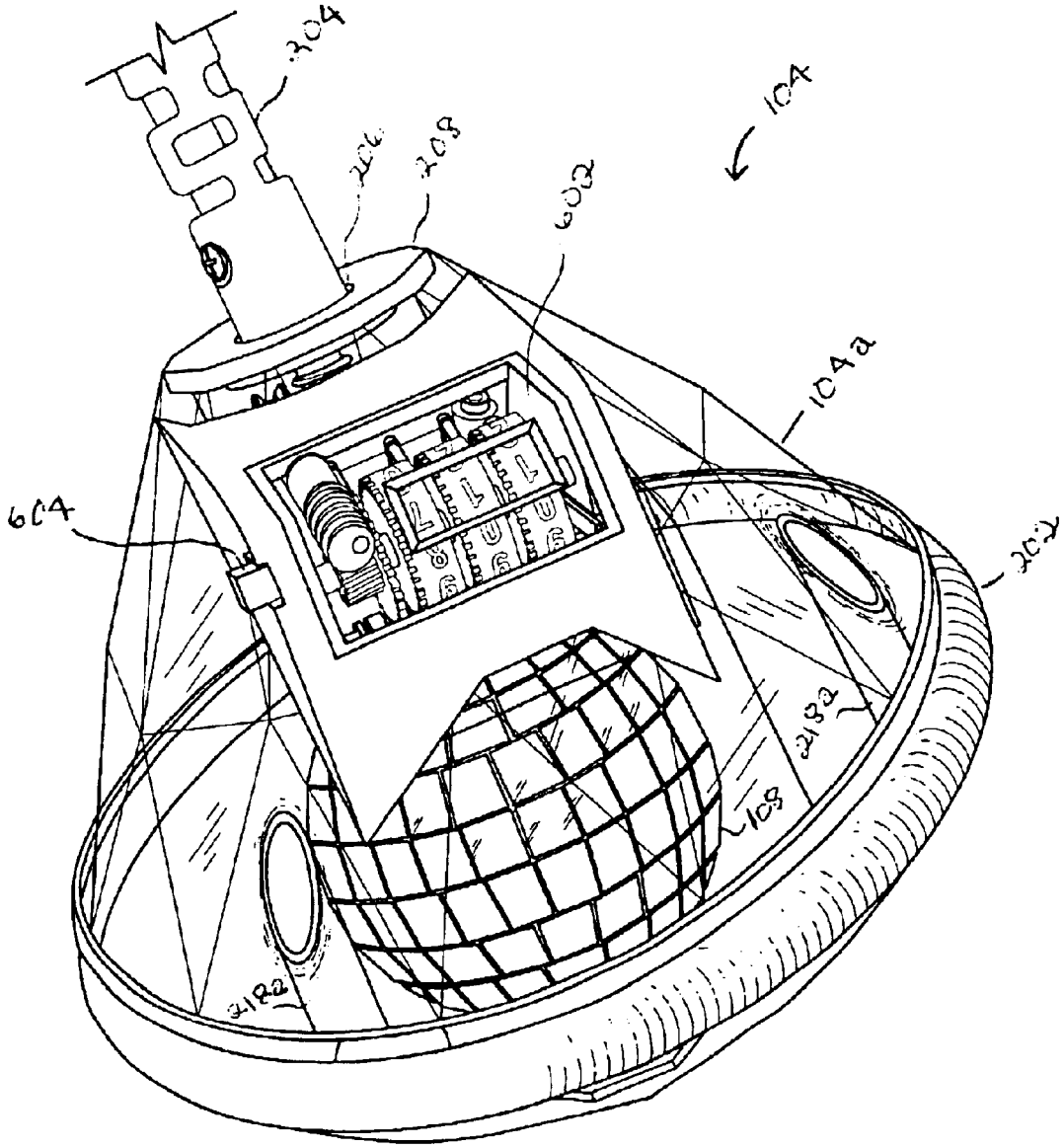
FIG. 6 is a perspective view of another implementation of a skipping toy.

FIG. 6 is a perspective view of another implementation of a skipping toy 600. In the skipping toy 600, a counter 602 with a re-set button 604 is included within the housing portion 104*a*. The counter 602 is designed to automatically count and visually display a number of rotations of the skipping toy 600 around the first leg of the player.

More specifically, during play and as explained above, the ring 202 revolves along a ground surface during play, relative to the axis defined by the shaft connector 204. Thus, a number of revolutions of the ring 202 around the axis of shaft connector 204 that corresponds to a full rotation of the housing 104 around the ankle region of the player causes the counter 602 to increment once.

Figure 7:
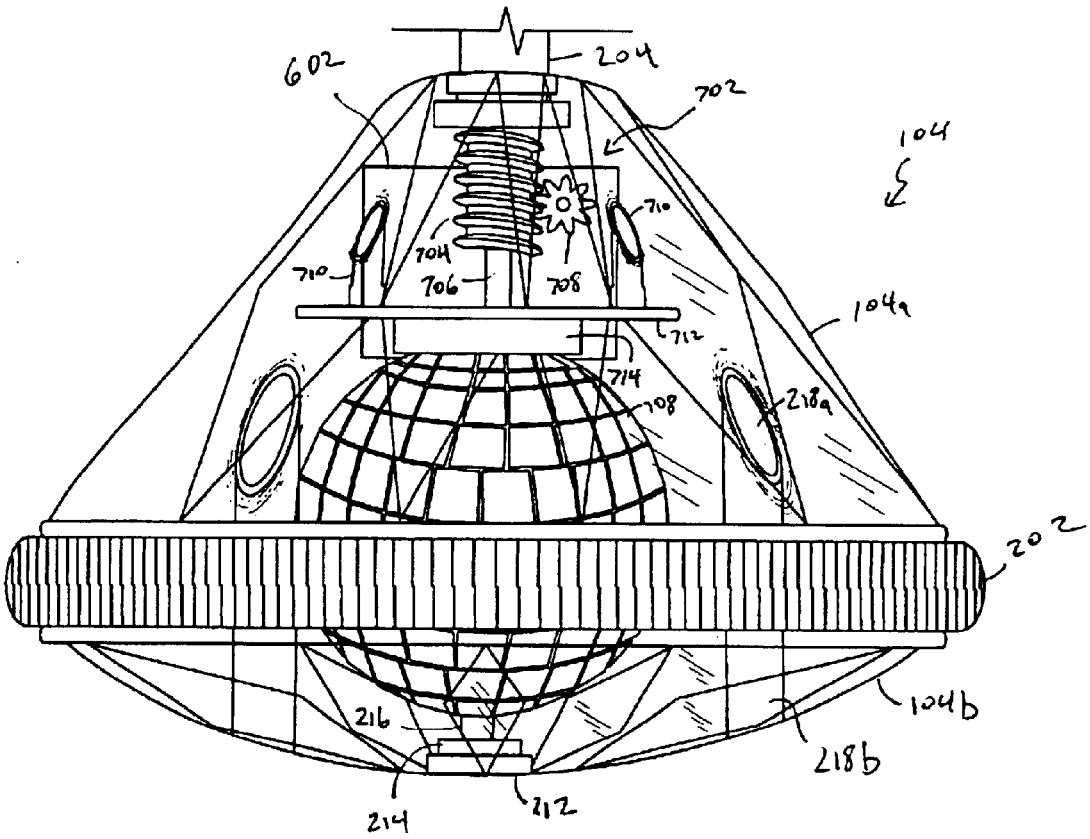
FIG. 7 is a rear view of the skipping toy of FIG. 6.

FIG. 7 is a rear view of the skipping toy 600 of FIG. 6. FIG. 7 illustrates a gear mechanism 702 for operating the counter 602. The gear mechanism 702 includes a first gear 704 that is wrapped around a shaft 706 that extends from, and in the direction of, the shaft connector 204. The first gear 702 engages a second gear 708, which, in turn, is connected to the counter 602. In order to accurately operate the counter 602, appropriate gear ratios for the gear mechanism 702 are selected relative to a length of the tether 606. An example of a counter/gear mechanism with appropriately-selected gear ratio(s) that may be used in conjunction with a skipping toy is illustrated in U.S. Pat. No. 4,875,675, which is incorporated by reference in its entirety.

The shaft 706, along with standards 710, supports a platform 712. The platform 712, in turn, supports a receptacle 714. Although not shown in FIG. 7, the receptacle 714 may contain a cup-shaped or concave portion (similar to portion 404 in FIGS. 4 and 5) for receiving the shaft 402 of the disco ball 108.

Various features of the skipping toys 100 and 600 may be appreciated with regard to the above-discussed FIGS. 1–5 and FIG. 6. For example, in FIGS. 1–5, and particularly in FIG. 4, it can be seen that the disco ball 108 is situated such that the ring 202 is concentric with an off-center cross-section of the disco ball 108. In contrast, in FIGS. 6 and 7, the ring 202 is concentric with an equator, or central cross-section, of the disco ball 108.

As can be understood from the above description, the ability to rotate one foot in a manner imparting circular rotation to a skipping toy while simultaneously raising the other foot in a timely coordinated fashion, thereby allowing the toy to traverse a circular path which is generally centered about the ankle of the player, is not only challenging, but also improves a player's dexterity and coordination. Adding to this game the reflective, multifaceted disco ball within a transparent housing, as described above, provides a visually stimulating and eye-catching enjoyable aspect to the game. Moreover, automatically counting the rotation of the skipping toy about the ankle of the player adds enjoyment and a competitive nature to the skipping toy.

A number of implementations have been described. Nevertheless, it will be understood that various modifications may be made. For example, the housing 104 is illustrated in FIG. 1 as being jewel shaped; however, in other implementations, the housing 104 may take any number of shapes. For example, the housing 104 may be spherical or ellipsoidal. Accordingly, other implementations are within the scope of the following claims.

What is claimed is:

1. A toy comprising:

a collar adapted to fit around an ankle region of a person;

a tether having a first end attached to the collar;

a housing attached to a second end of the tether; and a multi-faceted, reflective object mounted within the housing.

2. The toy of claim 1 wherein the housing is partially-transparent.

3. The toy of claim 1 wherein the object is spherical in shape.

4. The toy of claim 1 wherein the object is mounted within the housing so as to move independently of the housing.

5. The toy of claim 1 wherein the object is mounted within the housing by a pair of diametrically-opposed shaft elements extended from the object, where the shaft elements are aligned with an attachment shaft connecting the tether to the housing.

6. The toy of claim 5 wherein the shaft elements are received within a pair of cup-shaped elements inside the housing.

7. The toy of claim 1 wherein the object is mounted within the housing so as to rotate about an axis that corresponds to an axis defined by an attachment shaft connecting the tether to the housing.

8. The toy of claim 1 wherein the housing is weighted so as to rotatably engage a ground surface along a circumference of the housing during a rotation of the object around the ankle region, where the circumference is defined at an outermost diameter of the housing.

9. The toy of claim 8 wherein the object is mounted within the housing such that an equator of the object is aligned with the circumference of the housing.

10. The toy of claim 8 further comprising a counter contained within the housing and operable to produce and visually display a count corresponding to a number of successive rotations of the housing around the ankle region.

11. A toy comprising:

a loop adapted to encircle an ankle region of a user;

a semi-transparent housing containing a reflective polyhedron, where the polyhedron is movably mounted with respect to the housing; and a cord connecting the loop to the housing.

12. The toy of claim 11 wherein the polyhedron is spherical in outline.

13. The toy of claim 11 wherein opposing ends of the polyhedron are respectively mounted within a pair of concave elements.

14. The toy of claim 11 wherein a central axis of the polyhedron is aligned with the cord during a rotation of the housing around the ankle region.

15. The toy of claim 14 wherein the polyhedron is rotatable about the central axis.

16. The toy of claim 11 wherein a central cross-section of the polyhedron is aligned with an outer circumference of the housing.

17. The toy of claim 11 further comprising a counter operable to produce and display an indication corresponding to a number of successive rotations of the housing around the ankle region.

18. A method of operating a toy, the method comprising:

placing a loop around an ankle region of a first leg of a user;

moving the first leg so as to swing a housing attached to the loop by a tether around the ankle region;

moving a second leg of the user so as to avoid impeding the housing as it swings around the ankle region; and reflecting ambient light that passes through the housing off of a multi-sided element contained within the housing.

19. The method of claim 18 wherein reflecting ambient light through the housing comprises moving the element independently of the housing during the moving of the first leg.

20. The method of claim 18 further comprising implementing a counter to count successive rotations of the housing around the ankle region as a function of a number of revolutions of the housing around an axis defined by the tether during the moving of the first leg.

* * * * *